US010907505B2

(12) United States Patent
Desforges et al.

(10) Patent No.: US 10,907,505 B2
(45) Date of Patent: Feb. 2, 2021

(54) TURBINE FOR A TURBINE ENGINE AND METHOD OF ASSEMBLING SAME

(71) Applicant: Safran Aircraft Engines, Paris (FR)

(72) Inventors: Jean-Baptiste Vincent Desforges, Moissy-Cramayel (FR); Gaël Frédéric Claude Cyrille Evain, Moissy-Cramayel (FR)

(73) Assignee: Safran Aircraft Engines, Paris (FR)

( * ) Notice: Subject to any disclaimer, the term of this patent is extended or adjusted under 35 U.S.C. 154(b) by 197 days.

(21) Appl. No.: 15/812,117

(22) Filed: Nov. 14, 2017

(65) Prior Publication Data

US 2018/0156070 A1 Jun. 7, 2018

(30) Foreign Application Priority Data

Nov. 15, 2016 (FR) ..... 16 61045

(51) Int. Cl.

| | |
|---|---|
| ***F01D 25/24*** | (2006.01) |
| ***F01D 5/22*** | (2006.01) |
| ***F01D 9/04*** | (2006.01) |
| ***F01D 11/12*** | (2006.01) |

(52) U.S. Cl.

CPC ..... *F01D 25/246* (2013.01); *F01D 5/225* (2013.01); *F01D 9/04* (2013.01); *F01D 11/122* (2013.01); *F05D 2220/323* (2013.01); *F05D 2230/60* (2013.01); *F05D 2240/11* (2013.01)

(58) Field of Classification Search

CPC ..... F05D 2220/323; F05D 2230/60; F05D 2240/11; F01D 25/24; F01D 25/246; F01D 5/20; F01D 5/225; F01D 9/04; F01D 11/02; F01D 11/08; F01D 11/12; F01D 11/122; F01D 11/127

USPC ..... 415/173.6

See application file for complete search history.

(56) References Cited

U.S. PATENT DOCUMENTS

| | | | | |
|---|---|---|---|---|
| 4,623,298 A | | 11/1986 | Hallinger et al. | |
| 6,062,813 A | * | 5/2000 | Halliwell | F01D 9/04 415/173.1 |
| 7,334,984 B1 | * | 2/2008 | Stine | F01D 11/127 415/173.1 |

(Continued)

FOREIGN PATENT DOCUMENTS

| | | |
|---|---|---|
| EP | 0140736 A2 | 5/1985 |
| EP | 0 844 369 A1 | 5/1998 |

(Continued)

*Primary Examiner* — Nathaniel E Wiehe
*Assistant Examiner* — John S Hunter, Jr.
(74) *Attorney, Agent, or Firm* — Blank Rome LLP

(57) ABSTRACT

A method of assembling a turbine for a turbine engine that includes mounting annular sectors around the blades to form an abradable ring that includes a groove in a sector of the annular sectors. The method also includes engaging a first wiper of a particular blade of the blades with the groove of the sector. The method further includes axially engaging an assembly comprising the blades and the annular sectors in a casing of a turbine, so that fixing members of the annular sectors cooperate with flanges of the casing to fix the annular sectors in the casing, around the blades. The fixing members comprise at least one upstream fixing member fixed on a radially internal facing side of an upstream end of the annular sectors and at least one downstream fixing member arranged at a downstream end of the annular sectors.

20 Claims, 8 Drawing Sheets

(56) References Cited

U.S. PATENT DOCUMENTS

| | | | |
|---|---|---|---|
| 2005/0002780 | A1 | 1/2005 | Tanaka |
| 2013/0149125 | A1 | 6/2013 | Onishi et al. |

FOREIGN PATENT DOCUMENTS

| | | | | | |
|---|---|---|---|---|---|
| FR | 2 879 649 | A1 | | 6/2006 | |
| FR | 3 007 065 | A1 | | 12/2014 | |
| FR | 3036435 | A1 | | 11/2016 | |
| WO | WO 2013/156734 | A1 | | 10/2013 | |
| WO | WO-2014168804 | A1 | * | 10/2014 | ..... F01D 25/246 |

* cited by examiner

TURBINE FOR A TURBINE ENGINE AND METHOD OF ASSEMBLING SAME

CROSS-REFERENCE TO RELATED APPLICATIONS

This application claims the benefit of French Patent Application No. 1661045, filed Nov. 15, 2016, the contents of which is incorporated herein by reference.

TECHNICAL FIELD

The present invention relates to a turbine for a turbine engine, in particular for an aircraft turbojet engine or turboprop engine, as well as a method for assembling such a turbine.

BACKGROUND

A turbine engine, in particular a twin-spool turbine engine, conventionally comprises, from upstream to downstream, a fan, a low-pressure compressor, a high-pressure compressor, a combustion chamber, a high-pressure turbine and a low-pressure turbine.

By convention, in the present application, the terms "upstream" and "downstream" are defined with respect to the direction of flow of air in the turbine engine. Likewise, by convention in the present application, the terms "interior" and "exterior", "lower" and "upper" and "internal" and "external" are defined radially with respect to the axis of the turbine engine.

A low-pressure turbine of a turbine engine comprises a turbine shaft on which a plurality of successive stages are mounted, each comprising a bladed wheel and a nozzle. Each bladed wheel comprises a disc carrying at its external periphery blades coaxial with one another and with the shaft driving the rotor of the turbine by suitable means. Each nozzle comprises an internal annular platform and an external annular platform between which substantially radial vanes extend. The external platform of the nozzle comprises means for attachment and fixing on an external casing of the turbine. All the nozzles form the fixed part of the engine referred to as the stator.

The blades of each wheel of the rotor conventionally comprise wipers at their radially external periphery, cooperating with a ring of abradable material so as to form sealing means of the labyrinth seal type.

Such a structure is for example known from the document FR 2 879 649.

In order to guarantee high efficiency of the turbine engine, it is necessary to control the clearances at said seals and to limit leakage rates at the interface between the wipers of the blades and the ring made from abradable material.

There exists a need to further improve the efficacy of such labyrinth seals as well as the assembly of the turbine.

SUMMARY

The aim of the invention is in particular to afford a simple, effective and economical solution to this problem.

To this end, the invention proposes a turbine for a turbine engine, in particular for an aircraft turbojet engine or turboprop engine, comprising a casing and a rotor comprising blades, the radially external periphery of which comprises at least one first wiper extending radially outwards, sealing means extending radially around the blades and comprising a ring made from abradable material, the radially external ends of the first wipers being engaged in a groove in said ring made from abradable material so as to form a seal of the labyrinth type, characterised in that said ring is formed by a plurality of contiguous annular sectors, each ring sector comprising at least one fixing member cooperating with at least one complementary attachment flange of the casing so as to provide the mounting of each sector on the casing by axial movement of said sector with respect to the casing. The casing is configured so as to allow the mounting of the sectors in the casing, solely by axial movement of said sectors.

In this way, the various sectors can be mounted around the blade so as to form the ring made from abradable material, before axially engaging the assembly comprising in particular the blades and said sectors in the casing, so that the members for fixing the sectors cooperate with the flanges with a view to providing the fixing of said sectors in the casing, around the blades.

Each groove comprises for example a radially external cylindrical surface and two lateral surfaces or flanks, extending radially.

The depth, that is to say the radial dimension, of each groove is for example between 0.5 and 5 mm.

In this case, it is possible to have a first wiper that forms a seal of the labyrinth type with the walls of the groove, said seal having a large pressure drop, substantially greater than in the case of the prior art. This is because it is possible to have a first wiper that has a large radial dimension, engaged in a groove also with a large radial dimension, the mounting then being made possible by the sectorised structure of the ring and by the axial engagement of said sectors and blades in the turbine casing.

Each flange may comprise a first part extending radially from a cylindrical or frustoconical wall of the casing, and a second part extending axially, cooperating with the fixing member of the corresponding ring sector.

Each fixing member may comprise a section roughly in a U shape comprising arms extending axially and radially separated from each other, engaging on either side of an axial part of the complementary attachment flange.

The turbine may comprise at least one first fixing member and at least one second fixing member, offset axially with respect to each other, able to cooperate respectively with a first flange and a second flange of the casing.

Each ring sector may comprise a block of abradable material fixed to a support, each fixing member being formed by said support or fixed to said support.

Each blade may comprise at least one first wiper extending radially and at least one second wiper extending radially outwards with respect to the first wiper, the first wiper and the second wiper being offset axially with respect to each other.

The first wiper may be engaged in a first groove in the corresponding ring sector, the second wiper being engaged in a second groove in the ring sector.

The first wiper may be engaged in a first groove in the corresponding ring sector, the radially external end of the second wiper being situated in the vicinity of a surface in a portion of a cylinder of the ring sector.

The turbine may comprise a nozzle, comprising a radially external platform, in abutment on a flange of the casing, the sector comprising a fixing member fixing the external platform of the nozzle to the corresponding flange of the casing, while providing the fixing of the sector on said flange.

The turbine may comprise a first blade stage and a second blade stage surrounded respectively by a first ring and a second ring made from abradable material and formed from sectors so as to form a first and second labyrinth seal, the casing being configured so as to allow the mounting of the sectors in the casing, solely by axial movement of said sectors.

The invention also relates to a method for assembling a turbine of the aforementioned type, characterised in that it comprises the steps consisting of:

- mounting the sectors around the blade so as to form the ring made from abradable material,
- axially engaging the assembly comprising in particular the blades and said sectors in the casing, so that the fixing members of the sectors cooperate with the flanges so as to provide the fixing of said sectors in the casing, around the blades.

Such a method is simple and quick to implement and allows easy assembly or dismantling of the turbine.

The method may comprise the steps consisting of:

- mounting a first ring of sectors around a first blade stage, and axially engaging the assembly comprising in particular said blades and said sectors in the casing, so that the fixing members of the sectors cooperate with the corresponding flanges so as to provide the fixing of said sectors in the casing, around said blades,
- mounting a second ring of sectors around a second blade stage, and axially engaging the assembly comprising in particular said blades and said sectors in the casing, so that the fixing members of the sectors cooperate with the corresponding flanges so as to provide the fixing of said sectors in the casing, around said blades.

BRIEF DESCRIPTION OF THE DRAWINGS

The invention will be understood better and other details, features and advantages of the invention will emerge from a reading of the following description given by way of non-limitative example with reference to the accompanying drawings, in which.

DETAILED DESCRIPTION

Figure 1:
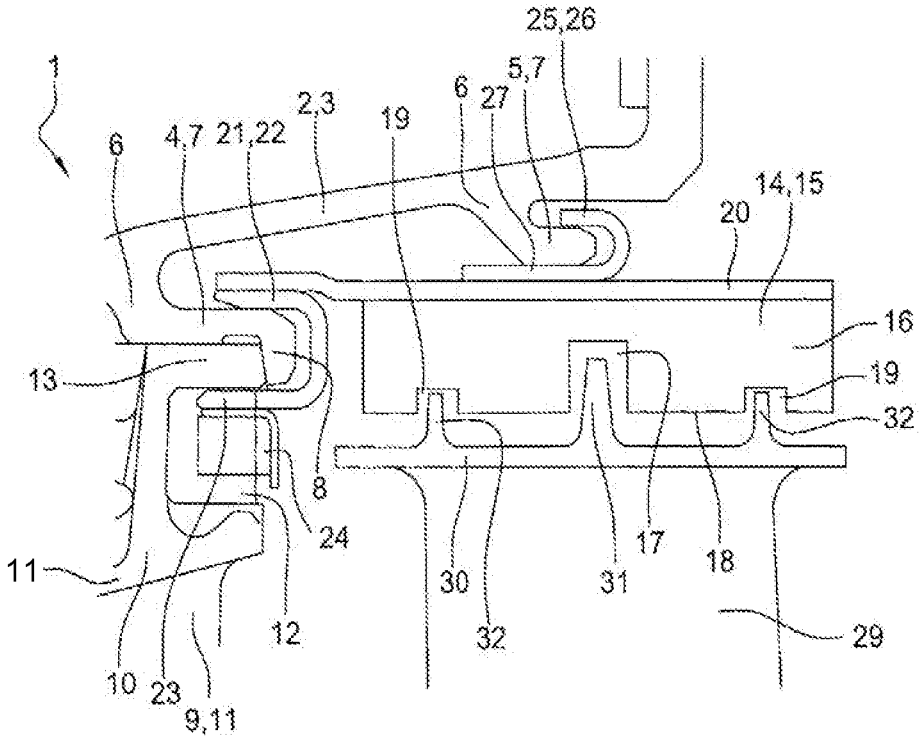
FIG. 1 is a view in axial section of a part of a turbine according to an embodiment of the invention.

A low-pressure turbine 1 of a turbine engine according to a first embodiment is illustrated in FIG. 1. The turbine 1 comprises a fixed casing 2, having a frustoconical wall 3 the axis of which corresponds to the axis of the turbine engine and from which flanges 4, 5 extend radially inwards. The casing 2 comprises in particular an upstream flange 4 and a downstream flange 5. The terms upstream and downstream are defined with respect to the direction of flow of the gas flow in the turbine 1, that is to say from left to right in FIG. 1.

Each flange 4, 5 comprises a first annular part 6 extending radially inwards from the frustoconical wall 3, and a second cylindrical part 7 extending in the downstream direction.

The upstream flange 4 further comprises an annular radial rim 8 extending radially inwards from the downstream end of the second part 7.

The stator of the turbine 1 comprises in particular a nozzle stage 9, referred to as the upstream nozzle. The nozzle 9 comprising a radially internal platform (not visible), a radially external platform 10 and fixed vanes 11 connecting said platforms.

The external platform 10 of the upstream nozzle 9 comprises a recess 12 delimiting a support zone formed by a radially external rim 13, extending axially in the downstream direction.

The downstream end of the rim 13 is in abutment axially on the rim 8 of the upstream flange 4 of the casing 2, said rim 13 further being in radial abutment on the second part 7 of the upstream flange 4.

The turbine 1 further comprises a ring 14 comprising an abradable material, mounted fixedly on the casing 2 and formed by a plurality of contiguous angular sectors 15, identical and distributed over the entire circumference. Each sector comprises a block of abradable material 16.

The ring formed by the various blocks 16 of abradable material comprises a first annular groove 17, having a first radial dimension or depth and emerging at a cylindrical radially internal surface 18 of the ring, and two second annular grooves 19, each having a second radial dimension or depth and emerging at said radially internal surface 18.

The first radial dimension is for example between 0.5 and 5 mm.

The second radial dimension is for example between 0.5 and 5 mm.

The two second grooves 19 are offset axially on either side of the first groove 17.

The external surface of the block 16 of each sector 15 is fixed to an annular-shaped support 20.

An annular fixing member 21 with a U-shaped cross section is fixed at the upstream end of the support 20, radially inside said support 20. Said upstream fixing member 21 comprises a radially external arm 22, coming radially into abutment on the external surface of the second part 7 of the upstream flange 4, and a radially internal arm 23 coming radially into abutment on the rim 13 of the upstream nozzle 9. A rotational-coupling member 24 is fixed to the internal arm 23 and is engaged in the recess 12 in the external platform 10 of the upstream nozzle 9, so as to rotationally immobilise the sector 15 with respect to the upstream nozzle 9 and casing 2.

The upstream nozzle 9 is thus fixed to the upstream flange 4 by means of the upstream fixing member 21. This member also makes it possible to fix the support 20 to the upstream flange 4.

Annular fixing members 25 with a U-shaped cross section or localised members such as hooks with a U-shaped cross section are fixed at an axially middle zone of the support 20, radially outside said support 20. Said fixing members 25, which will be referred to hereinafter as downstream fixing members, comprise a radially external arm 26 and a radially internal arm 27, able to come into abutment respectively on the radially external surface and the radially internal surface of the downstream flange 5.

The downstream fixing members 25 thus make it possible to fix the support 20 to the downstream flange 5 of the casing 2.

Figure 2:
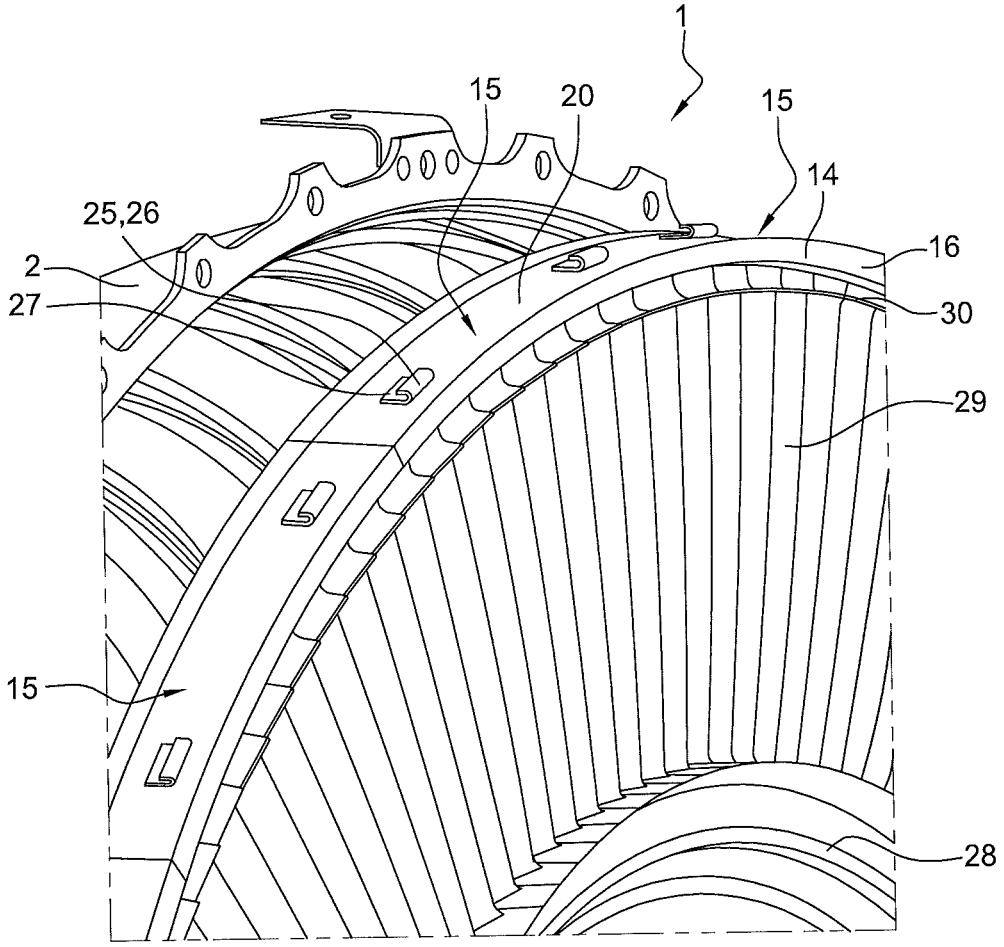
FIG. 2 is an exploded view, in perspective, of a part of the turbine.
Figure 3:
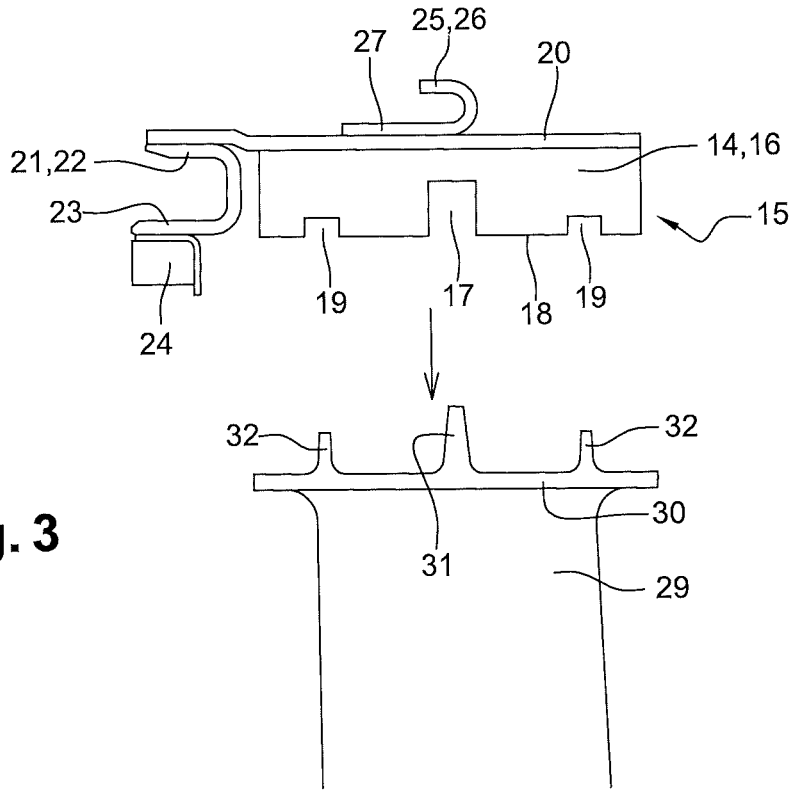
FIGS. 3 to 5 illustrate various steps of assembling the turbine of FIGS. 1 and 2.
Figure 4:
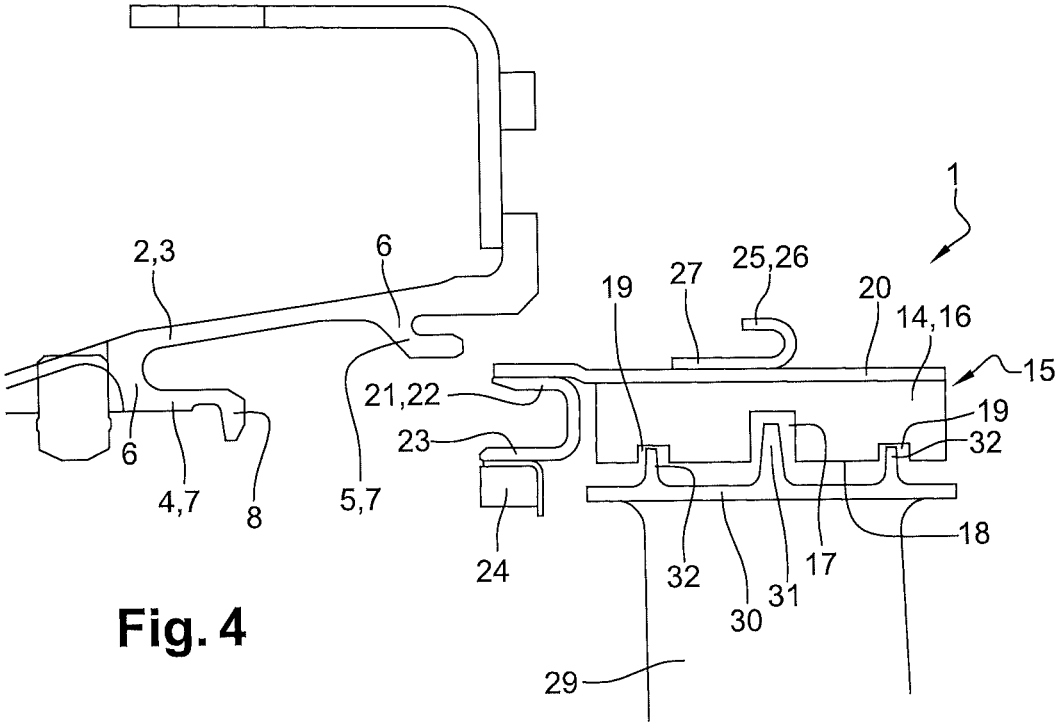
Figure 5:
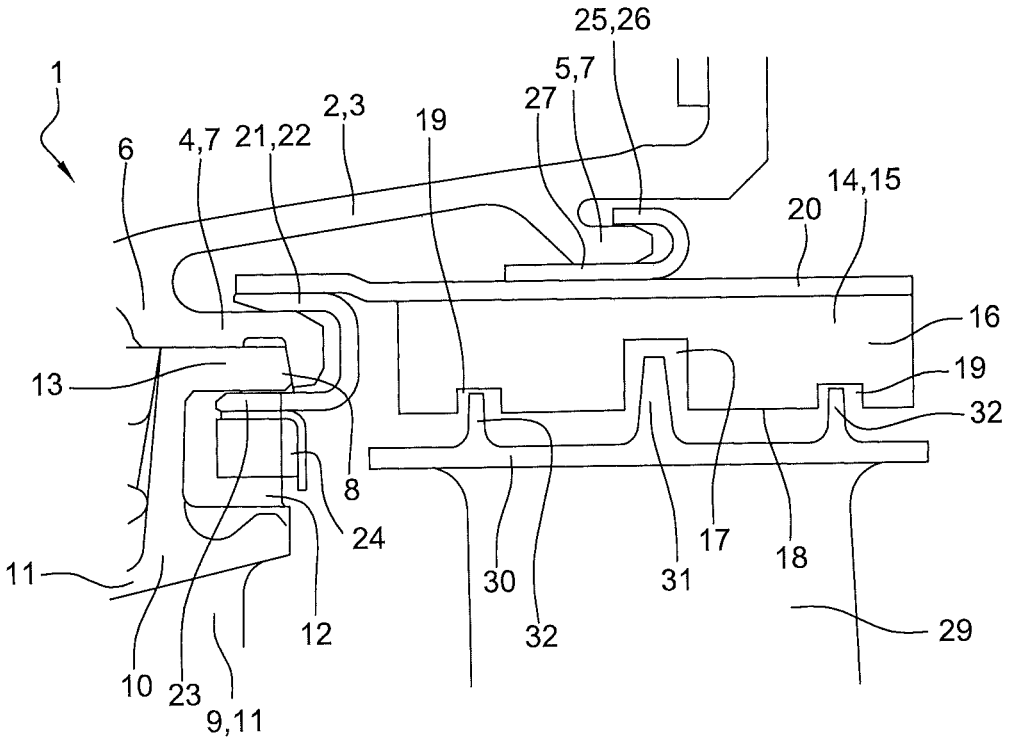

The turbine 1 further comprises a rotor wheel comprising a disc 28 (FIG. 2) at the periphery of which blades 29 are mounted, the radially external periphery of each blade comprises a platform 30 comprising a first wiper 31, axially central, and two second wipers 32 offset axially on either side of the first wiper 31. The first and second wipers 31, 32 extend radially outwards, the first wiper 31 extending radially outwards with respect to the second wipers 32. The first wiper 31 is engaged in the first group 17, the second wipers 32 being engaged in the second grooves 19.

The axial dimension of the grooves 17, 19 allows a movement or an uncertainty of axial positioning of the rotor wheel, and therefore of the wipers 31, 32, with respect to the casing 2, such uncertainty being able to be due to the manufacturing or assembly tolerances as well as to mechanical and/or thermal stresses in operation.

The assembly of such a turbine 1 is carried out as follows.

First of all the upstream nozzle 9 is mounted inside the casing 2, on the one hand, and the sectors 15 are mounted around the blades 29 so as to form the ring 14 made from abradable material.

The assembly comprising the rotor wheel comprising the disc 28 and the blades 29, as well as the ring 14 formed by said sectors 15, is next engaged axially inside the casing 2, so that the fixing members 21 are engaged axially on the upstream flange 4 and on the rims 13 of the upstream nozzle 9, and so that the downstream fixing members 25 are engaged axially on the downstream flange 5, thus providing the fixing of both the upstream nozzle 9 and the various sectors 15 on the casing 2.

Figure 6:
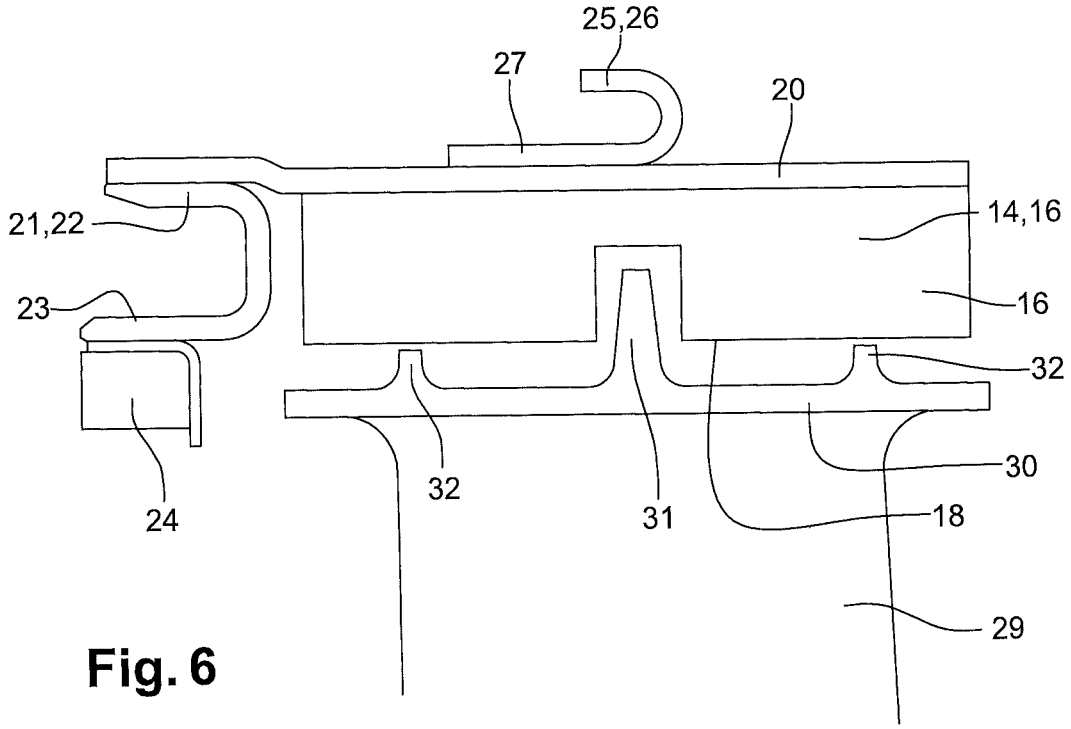
FIG. 6 illustrates a blade and an abradable sector of a turbine according to a variant embodiment of the invention.

FIG. 6 shows a variant embodiment that differs from the one disclosed above in that the ring formed by the blocks 16 has no second grooves 19, the second wipers 32 coming opposite the radially internal cylindrical surfaces 18 of the blocks 16 of abradable material.

Figure 7:
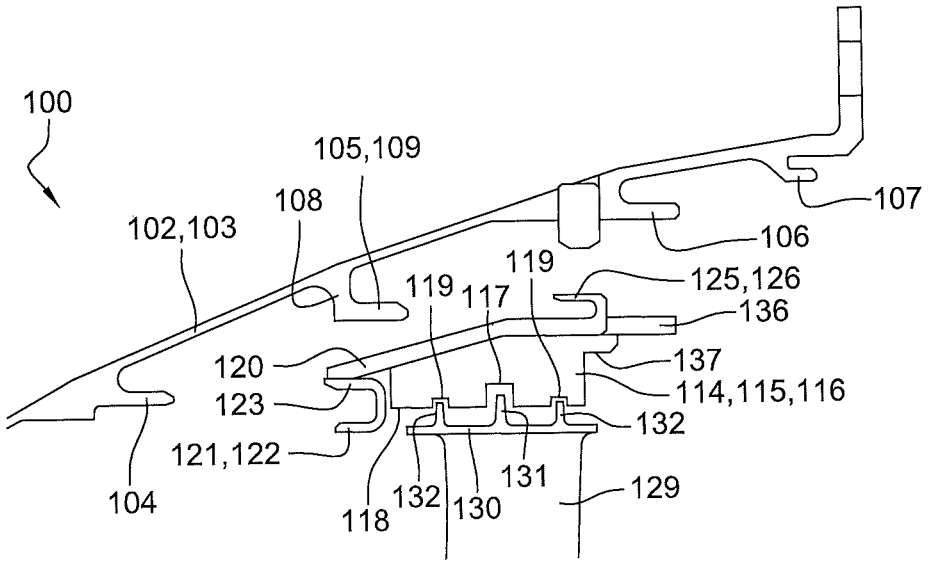
FIGS. 7 to 13 illustrate various steps of assembling a turbine according to another embodiment of the invention.
Figure 13:
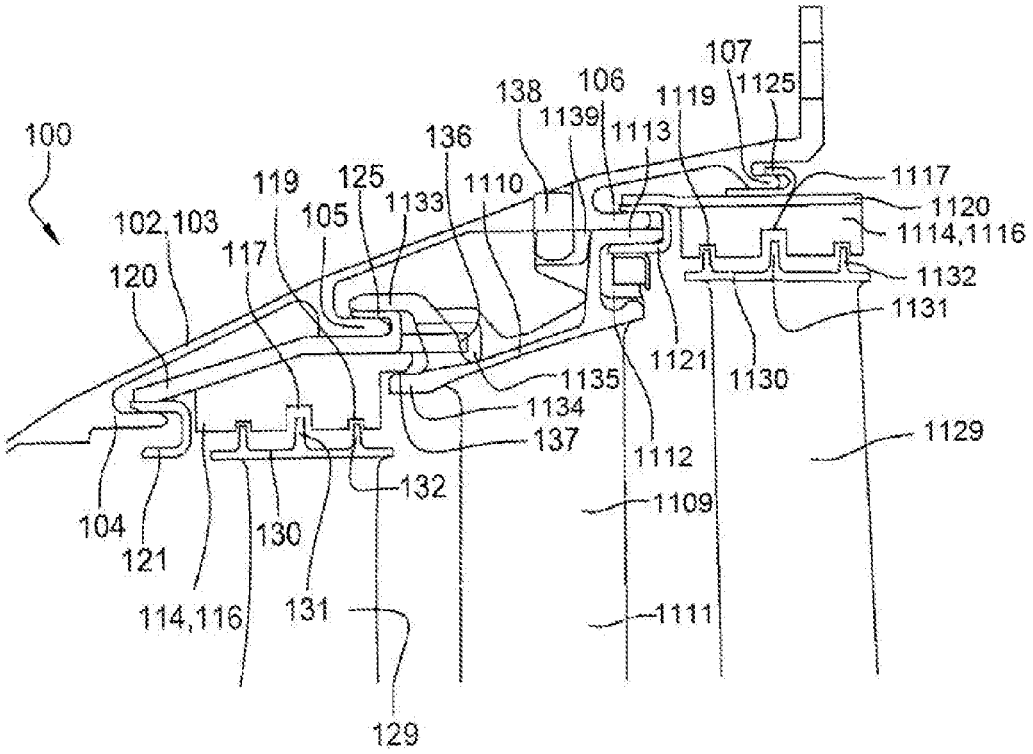

FIGS. 7 and 13 illustrate the various steps of assembling a turbine 100 according to another embodiment of the invention. In this embodiment, the turbine 100 comprises a fixed casing 102, having a frustoconical wall 103 the axis of which corresponds to the axis of the turbine engine and from which flanges referenced 104, 105, 106, 107 from upstream to downstream extend radially inwards. The terms upstream and downstream are defined with reference to the direction of flow of the gas flow in the turbine 100, that is to say from left to right in FIG. 9.

Each flange 104, 105, 106, 107 comprises a first annular part 108 extending radially inwards from the frustoconical wall 103, and a second cylindrical part 109 extending in the downstream direction. The flanges 104, 105, 106, 107 are offset axially from one another, from upstream to downstream, and radially from inside to outside.

In other words:

- the axial part 109 of the flange 104 is thus situated radially inside the axial part 109 of the flange 105 situated directly downstream of the flange 104,
- the axial part 109 of the flange 105 is thus situated radially inside the axial part 109 of the flange 106 situated directly downstream of the flange 105,
- the axial part 109 of the flange 106 is thus situated radially inside the axial part 109 of the flange 107 situated directly downstream of the flange 106.

As can be seen more clearly in FIG. 13, the turbine comprises an upstream ring 114 and a downstream ring 1114. Each ring 114, 1114 comprises an abradable material, mounted fixedly on the casing 102 and formed by a plurality of angular sectors 115, 1115 (FIG. 7, FIG. 11), contiguous, identical and distributed over the entire circumference. Each sector 115, 1115 comprises a block of abradable material 116, 1116.

The ring formed by the various blocks 116, 1116 of abradable material comprises a first annular groove 117, 1117, having a first radial dimension or depth and emerging at a cylindrical radially internal surface 118 (FIG. 7), 1118 (FIG. 11) of the ring, and two second annular grooves 119, 1119, each having a second radial dimension or depth and emerging at said radially internal surface 118,1118.

The first radial dimension is for example between 0.5 and 5 mm.

The second radial dimension is for example between 0.5 and 5 mm.

The two second grooves 119, 1119 are offset axially on either side of the first groove 117, 1117.

The external surface of the block 116, 1116 of each sector is fixed to an annular-shaped support 120, 1120. The support may be cylindrical, as in the case of the support 1120 of the downstream part of the turbine 100. The support may also comprise at least one frustoconical part, as in the case of the support 120 of the upstream part of the turbine 100.

An annular fixing member 121, 1121 with a U-shaped cross section is fixed at the upstream end of the support 120, 1120, radially inside said support 120, 1120. Said upstream fixing member 121, 1121 comprises a radially external arm 122, 1122 (FIG. 7, FIG. 11), coming radially into abutment on the external surface of the second part 109 of the corresponding flange 104, 106, and a radially internal arm 123, 1123, coming radially into abutment on a rim 1113 of the external platform 1110 of a nozzle 1109 situated upstream. A rotational coupling member 1124 is fixed to the internal arm 1123 and is engaged in a recess 1112 of the external platform 1110 of the nozzle 1109, so as to rotationally immobilise the sector of the ring 1114 with respect to the nozzle 1109 and casing 102.

As before, each nozzle 1109 comprises a radially internal platform (not visible), a radially external platform 1110 and fixed vanes 1111 connecting said platforms.

The nozzle 1109 is thus fixed to the corresponding flange 106 by means of the fixing member 1121. This member 1121 also makes it possible to fix the support 1120 to the flange 106.

The external platform 1110 of the nozzle 1109 comprises moreover, at its upstream end, a radially external rim 1133 and a radially internal rim 1134, as well as a recess 1135 emerging towards the upstream end and situated radially between the rims 1133 and 1134.

Annular fixing members 125, 1125 with a U-shaped cross section or localised members such as hooks with a U-shaped cross section are fixed at a downstream zone of the support 120 or at an axially middle zone of the support 1120, radially outside the support 120, 1120. Said fixing members 125, 1125, which will be referred to hereinafter as downstream fixing members, each comprise a radially external arm 126, 1126 (FIG. 7, FIG. 11) and a radially internal arm 1127 secured to the support 120, 1120 or which may be coincident with the support 120, 1120, said external and internal arms being able to come into abutment respectively on the radially external surface and radially internal surface of the corresponding flange 105, 107.

The downstream fixing members 125, 1125 thus make it possible to fix the support 120, 1120 to the corresponding flange 105, 107 of the casing 102.

Moreover, the support 120 of each sector 115 is extended in the downstream direction by at least one finger 136 engaged by complementarity of shapes in the recess 1135 of the nozzle 1109 so as to effect a rotational coupling of the nozzle 1109 and sector 115 concerned.

Finally, the block of abradable material 116 of each sector 114 comprises an indentation at its downstream end, delimiting a shoulder 137.

Figure 11:
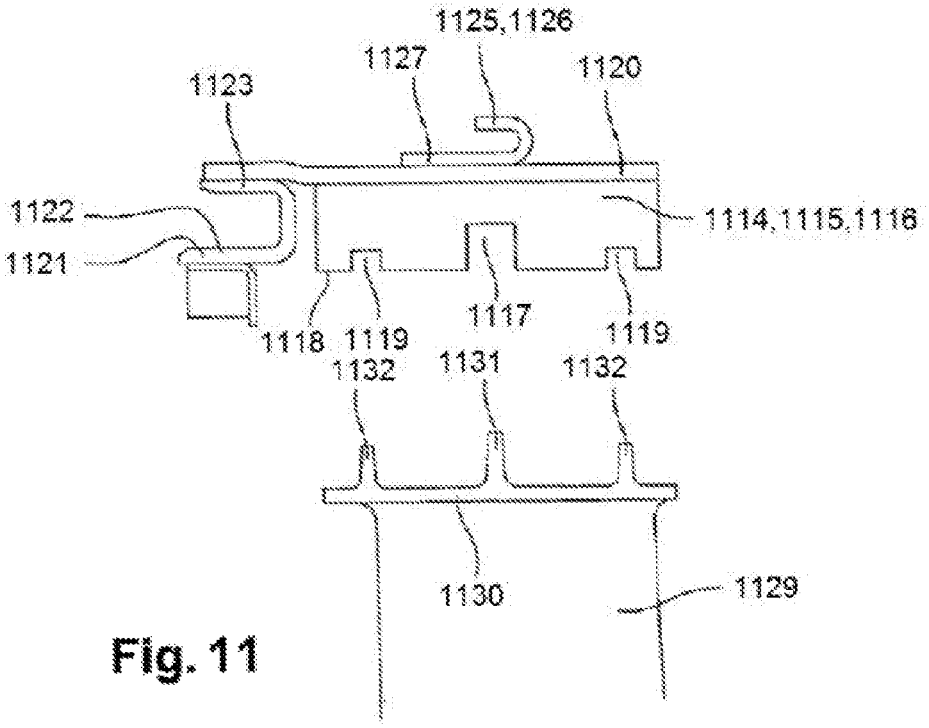

The turbine 100 further comprises rotor wheels each comprising a disc at the periphery of which blades 129, 1129 are mounted. The radially external periphery of each blade 129, 1129 comprises a platform 130, 1130 comprising a first wiper 131, 1131, axially central, and two second wipers 132, 1132 offset axially on either side of the first wiper 131, 1131 (FIG. 7, FIG. 11). The first and second wipers 131, 1131, 132, 1132 extend radially outwards, the first wiper 131, 1131 extending radially outwards with respect to the second wipers 132, 1132. The first wiper 131, 1131 is engaged in the first groove 117, 1117, the second wipers 132, 1132 being engaged in the second grooves 119, 1119 (FIG. 13).

As before, the axial dimension of the grooves 117, 1117, 119, 1119 allows a movement or uncertainty of axial positioning of the rotor wheel, and therefore of the wipers 131, 1131, 132, 1132 with respect to the casing 102, such uncertainty being able to be due to the manufacturing and assembly tolerances as well as to mechanical and/or thermal stresses in operation.

The assembly of such a turbine 100 is carried out as follows.

First of all an upstream nozzle (not shown in FIGS. 7 to 13) is mounted in said casing 102, on the one hand, and the sectors 115 are mounted around the blades 129 so as to form the ring 114 made from abradable material, on the other hand (FIG. 7).

Figure 8:
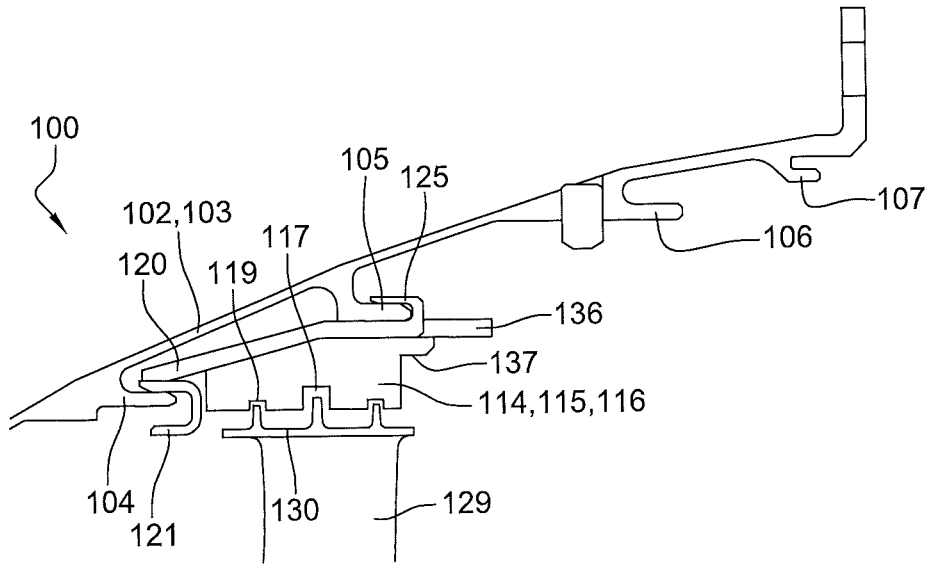

The assembly comprising the upstream rotor wheel comprising the disc and the blades 129, as well as the ring 114 formed by said sectors 115, is next engaged axially from downstream to upstream inside the casing 102, so that the fixing members 121 are engaged axially on the flange 104 and on the corresponding rims of the upstream nozzle, and so that the downstream fixing members 125 are engaged axially on the flange 105, thus providing the fixing both of the upstream nozzle and of the various sectors 115 on the casing 102 (FIG. 8).

Figure 9:
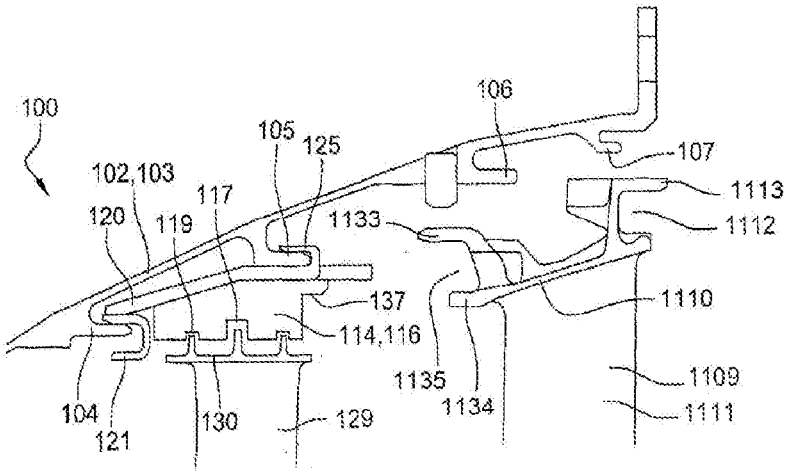
Figure 10:
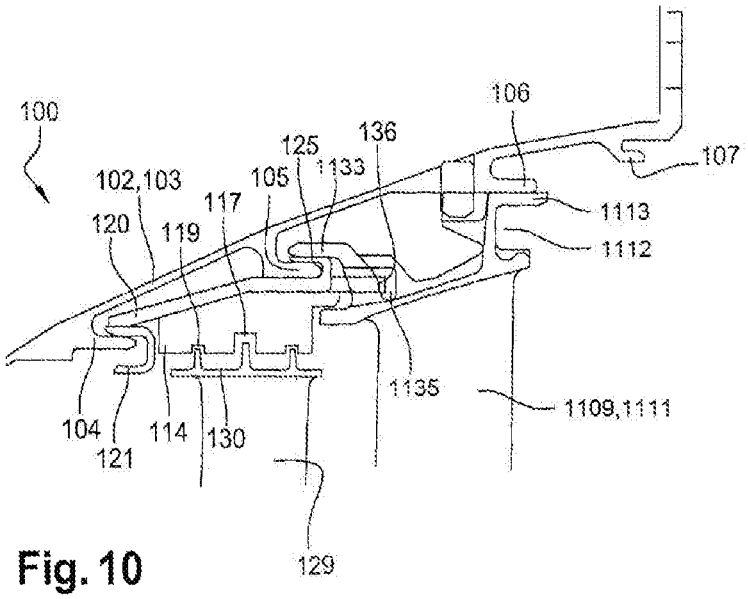

The downstream nozzle 1109 is next mounted inside the casing 102, the radially external rim 1133 coming to be housed outside the radially external arm of the fixing member 125, the radially internal rim 1134 coming to be housed inside the shoulder 137 (FIGS. 9 and 10). Moreover, the finger 136 comes to be housed in the indentation 1135 and an anti-rotation finger 138 mounted in the casing 102 comes to be housed in an indentation 1139 in the nozzle 1109 so as to prevent rotation of the nozzle 1109 with respect to the casing 102, and therefore also rotation of the sectors 115 with respect to the casing 102, through the fingers 136.

Figure 12:
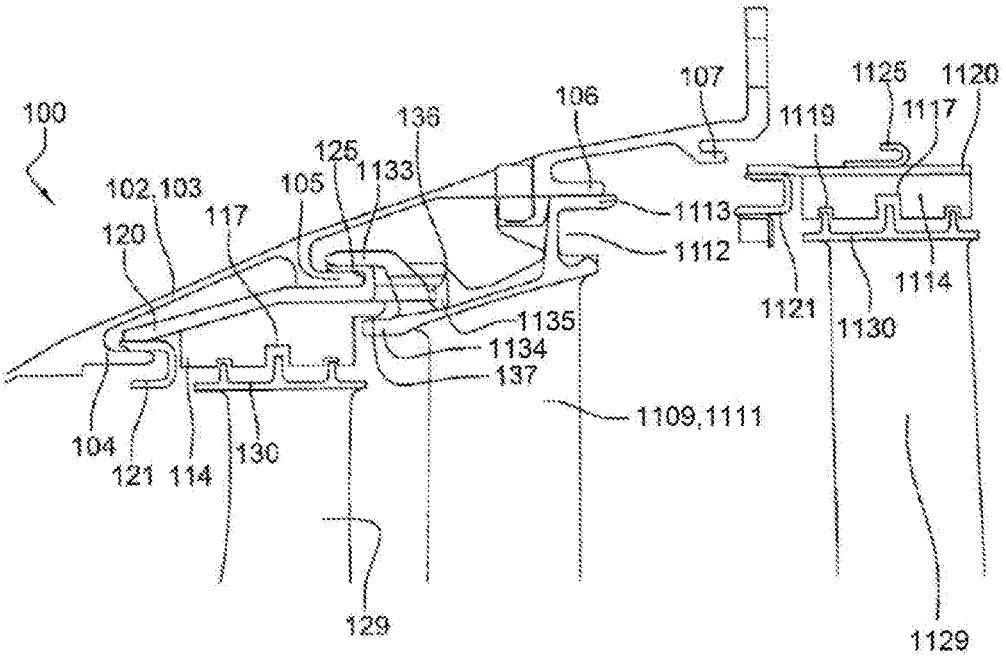

The assembly comprising the downstream rotor wheel comprising the disc and the blades 1129, as well as the ring 1114 formed by said sectors 1115, is next engaged axially from downstream to upstream inside the casing 102, so that the fixing members 1121 are engaged axially on the flange 106 and on the rims 1113 of the downstream nozzle 1109, and so that the downstream fixing members 1125 are engaged axially on the flange 107, thus providing the fixing both of the downstream nozzle and of the various sectors 1115 on the casing 102 (FIGS. 11, 12 and 13).

Whatever the embodiment of the invention, in each assembly step, the sectors 15, 115, 1115 are engaged axially in a solely axial direction, directed from downstream to upstream. This is allowed in particular by the configuration of the casing 2, 102, in particular by the positioning of the flanges 4, 5, 104, 105, 106, 107 with respect to one another, in particular by the radial offset thereof. It will be recalled in fact that the flanges are separated, from upstream to downstream, radially from inside to outside. This considerably facilitates the mounting of the sectors 15, 115, 1115 in the casing 2, 102.

The invention claimed is:

1. A method comprising the steps of:

mounting annular sectors around blades of a rotor to form an abradable ring that includes a groove in a sector of the annular sectors, engaging a first wiper of a particular blade of the blades with the groove of the sector, and axially engaging an assembly comprising the blades and the annular sectors in a casing of a turbine, so that fixing members of the annular sectors cooperate with flanges of the casing to fix the annular sectors in the casing, around the blades, wherein the fixing members comprise at least one upstream fixing member fixed on a radially internal facing side of an upstream end of the annular sectors and at least one downstream fixing member arranged at a downstream end of the annular sectors.

2. The method of claim 1, wherein each of the flanges comprises a first part extending radially from a cylindrical or frustoconical wall of the casing, and a second part extending axially, and wherein the step of engaging the assembly comprising the blades and the annular sectors of the turbine comprises engaging the fixing members with the second parts of the flanges.

3. The method of claim 1, wherein each of the fixing members comprises a U-shaped section comprising arms extending axially and separated radially from each other, the method including engaging the U-shaped section on both sides of an axial part of a complementary attachment flange.

4. The method of claim 1, wherein the at least one upstream fixing member and at least one downstream fixing member are offset axially with respect to each other, wherein the flanges of the casing include a first flange and a second flange, and wherein axially engaging the assembly comprising the blades and the annular sectors in the casing includes attaching the at least one upstream fixing member to the first flange and attaching the at least one downstream fixing member to the second flange.

5. The method of claim 1, wherein each of the annular sectors comprises a block of abradable material fixed to a support, wherein the at least one downstream fixing member of the annular sectors is formed by the support or fixed to the support.

6. The method of claim 1, wherein the particular blade further includes a second wiper, wherein the first wiper extends radially and the second wiper extending radially outwards with respect to the first wiper, the first wiper and the second wiper being offset axially with respect to each other.

7. The method of claim 6, wherein the sector of the annular sectors further includes a second groove, the method further comprising engaging the second wiper in the second groove.

8. The method of claim 6, further comprising positioning a radially external end of the second wiper near a surface in a portion of a cylinder of the sector of the annular sectors.

9. The method of claim 1, wherein the turbine includes a nozzle having a radially external platform abutment on a first flange of the flanges of the casing, and wherein the step of axially engaging the assembly comprising the blades and the annular sectors in the casing of the turbine comprises attaching a first fixing member of the fixing members to the radially external platform and to a corresponding flange of the flanges of the casing.

10. The method of claim 1, further comprising the steps of:

mounting a first ring of sectors of the annular sectors around a first blade stage, and axially engaging the assembly so that at least one upstream fixing member of the first ring of sectors cooperate with first corresponding flanges of the casing to fix the first sectors in the casing, around the blades, and mounting a second ring of sectors of the annular sectors around a second blade stage, and axially engaging the assembly so that the at least one downstream fixing member of the second ring of sectors cooperate with second corresponding flanges of the casing to fix the second sectors in the casing, around the blades.

11. The method of claim 10, wherein the first ring of annular sectors comprises an upstream part and a downstream part arranged downstream of the upstream part, the upstream part having a frustoconical configuration.

12. The method of claim 10, wherein the first ring of annular sectors comprises an upstream part and a downstream part arranged downstream of the upstream part, the downstream part comprising a finger extending in a downstream direction into an upstream facing recess in a nozzle so as to effect a rotational coupling of the nozzle and a respective annular sector.

13. The method of claim 1, wherein at least one of the fixing members is configured as a hook.

14. A turbine for a turbine engine, the turbine comprising:

a casing; and a rotor comprising blades having a radially external periphery, each blade comprising at least one first wiper extending radially outwards, the radially external periphery extending radially around the blades and comprising a plurality of contiguous annular sectors, each annular sector comprising:

an upstream fixing member fixed on a radially internal facing side of an upstream end of the annular sector and configured to engage with an upstream flange of the casing; and a downstream fixing member arranged at a downstream end of the annular sector and configured to engage with a downstream flange of the casing, wherein the engagement of the upstream fixing member with the upstream flange and downstream fixing member with the downstream flange providing for mounting of the annular sector on the casing by axial movement of the annular sector with respect to the casing.

15. The turbine of claim 14, wherein at least one of the upstream fixing member and downstream fixing member is configured as a hook.

16. The turbine of claim 14, wherein the radially external periphery comprises:

a first ring of sectors of the annular sectors configured around a first blade stage such that each upstream fixing member of the first ring of sectors cooperates with a corresponding upstream flange to fix the first sectors in the casing and around the blades; and a second ring of sectors of the annular sectors configured around a second blade stage such that each downstream fixing member of the second ring of sectors cooperates with a corresponding downstream flange to fix the second sectors in the casing and around the blades.

17. The turbine of claim 16, wherein the first ring of annular sectors comprises an upstream part and a downstream part arranged downstream of the upstream part, the upstream part having a frustoconical configuration.

18. The turbine of claim 16, wherein the first ring of annular sectors comprises an upstream part and a downstream part arranged downstream of the upstream part, the downstream part comprising a finger extending in a downstream direction into an upstream facing recess in a nozzle so as to effect a rotational coupling of the nozzle and a respective annular sector.

19. The turbine of claim 14, wherein the downstream flange and upstream flange each comprises a first part extending radially from a cylindrical or frustoconical wall of the casing, and a second part extending axially, and wherein the upstream fixing member and downstream fixing member are engaged with the with the second part of the upstream flanges and the second part of the downstream flange, respectively.

20. The turbine of claim 14, wherein the downstream fixing member and upstream fixing member each comprises a U-shaped section comprising arms extending axially and separated radially from each other, the U-shaped section of the downstream fixing member configured to engage on both sides of an axial part of the downstream flange and the U-shaped section of the upstream fixing member configured to engage on both sides of an axial part of the upstream flange.

* * * * *